US008381876B1

(12) United States Patent
Darden

(10) Patent No.: US 8,381,876 B1
(45) Date of Patent: Feb. 26, 2013

(54) TREE CLIMBING TREE STAND

(76) Inventor: Rick R. Darden, Wesley Chapel, FL (US)

( * ) Notice: Subject to any disclaimer, the term of this patent is extended or adjusted under 35 U.S.C. 154(b) by 702 days.

(21) Appl. No.: 12/221,323

(22) Filed: Aug. 1, 2008

(51) Int. Cl.
*A63B 27/00* (2006.01)

(52) U.S. Cl. ..... 182/187; 182/188; 182/136

(58) Field of Classification Search ..... 182/136, 182/187, 188
See application file for complete search history.

(56) References Cited

U.S. PATENT DOCUMENTS

| | | | | | |
|---|---|---|---|---|---|
| 1,586,058 | A * | 5/1926 | Winfield | 224/637 |
| 3,733,017 | A * | 5/1973 | Pletz | 224/634 |
| 4,428,459 | A * | 1/1984 | Peck | 182/187 |
| 4,493,395 | A * | 1/1985 | Rittenhouse | 182/187 |
| 4,582,165 | A * | 4/1986 | Latini | 182/20 |
| 4,787,476 | A * | 11/1988 | Lee | 182/116 |
| 4,819,763 | A * | 4/1989 | Grote | 182/187 |
| 4,890,694 | A * | 1/1990 | Williams | 182/187 |
| 4,936,416 | A * | 6/1990 | Garon | 182/187 |
| 5,205,375 | A * | 4/1993 | Shriver | 182/187 |
| 5,265,780 | A * | 11/1993 | Matthews et al. | 224/155 |
| 5,316,104 | A * | 5/1994 | Amacker | 182/187 |
| 6,206,138 | B1 * | 3/2001 | Yerger | 182/136 |
| 6,510,922 | B1 * | 1/2003 | Hodnett | 182/187 |
| 6,622,823 | B2 * | 9/2003 | Engstrom | 182/136 |
| 2003/0024767 | A1 * | 2/2003 | Lane | 182/136 |

OTHER PUBLICATIONS

Definition of 'flexible' provided in the Action The American Heritage® Dictionary of the English Language, Fourth Edition copyright © 2000 by Houghton Mifflin Company. Updated in 2009. Published by Houghton Mifflin Company. All rights reserved.*

* cited by examiner

*Primary Examiner* — Katherine W Mitchell
*Assistant Examiner* — Daniel Cahn
(74) *Attorney, Agent, or Firm* — Edward P Dutkiewicz

(57) ABSTRACT

A tree climbing tree stand comprising, in combination a lower foot portion. The lower foot portion has a lower flexible tree strap coupled there to. There is also provided an upper portion. The upper portion has an upper flexible tree strap coupled there to.

5 Claims, 6 Drawing Sheets

FIG 2
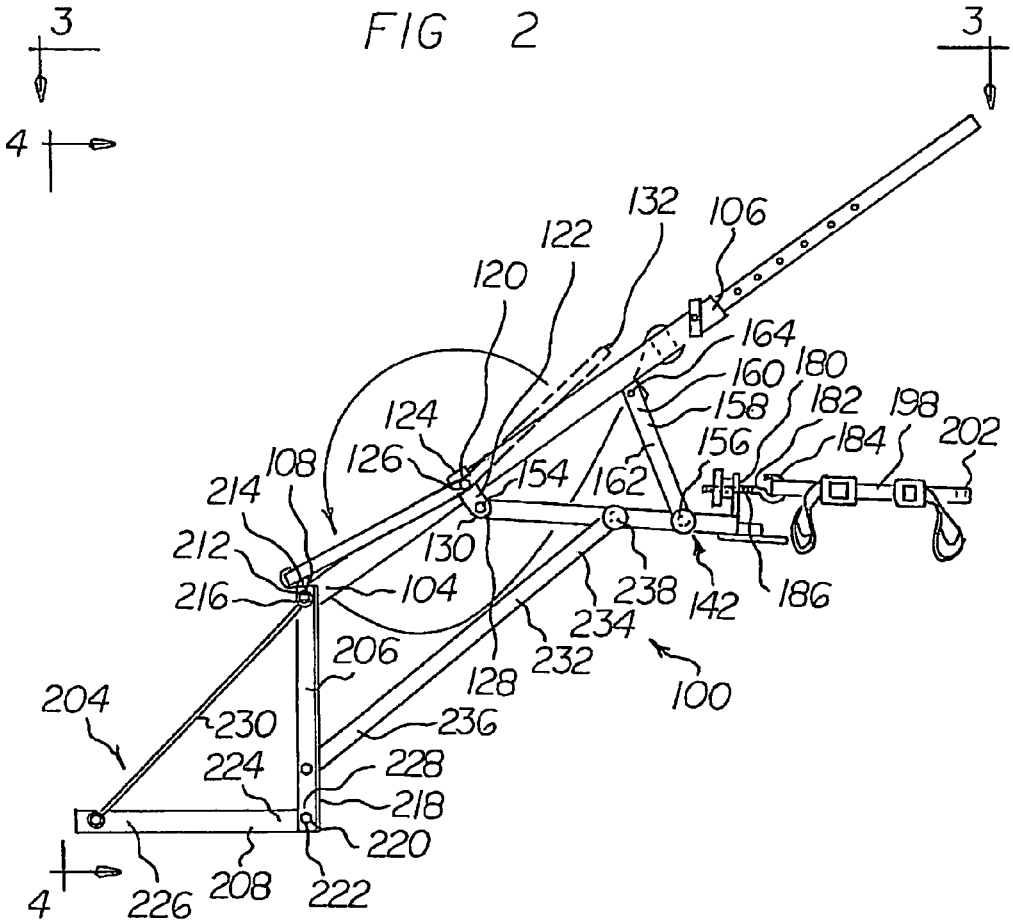
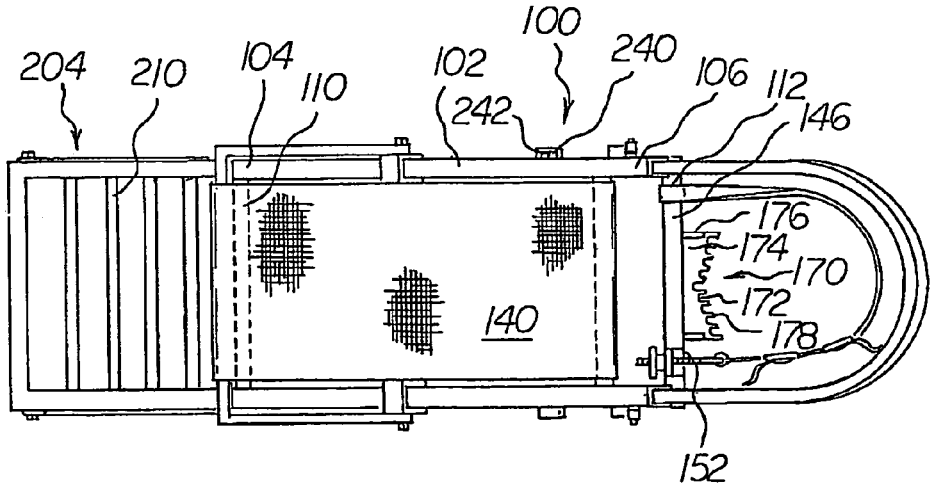
FIG 3

FIG 6
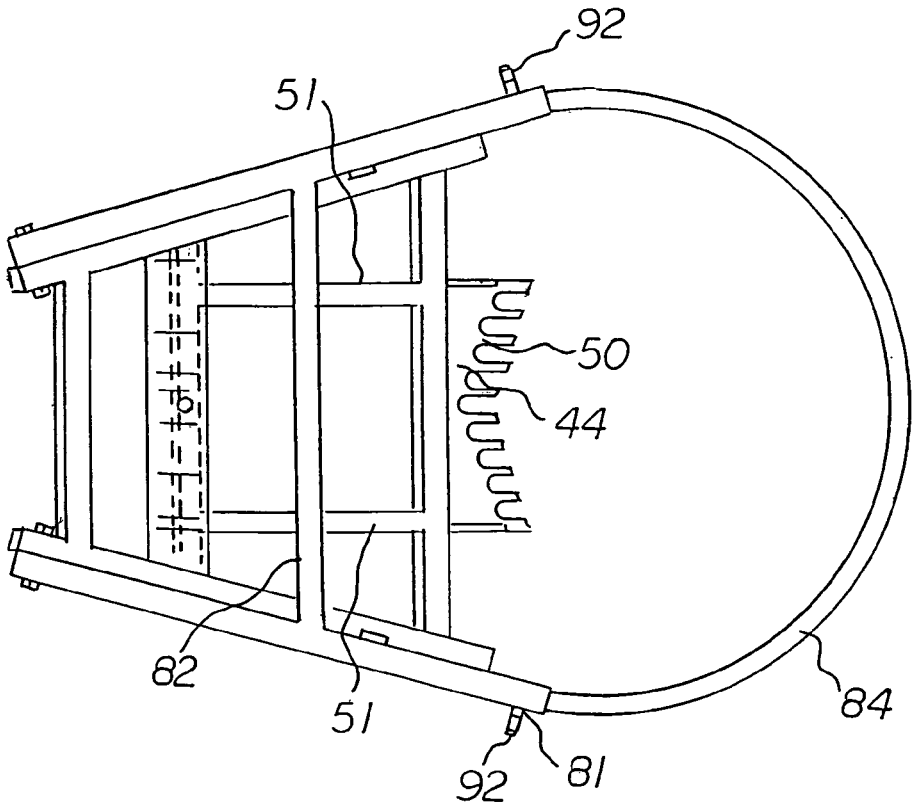
FIG 7
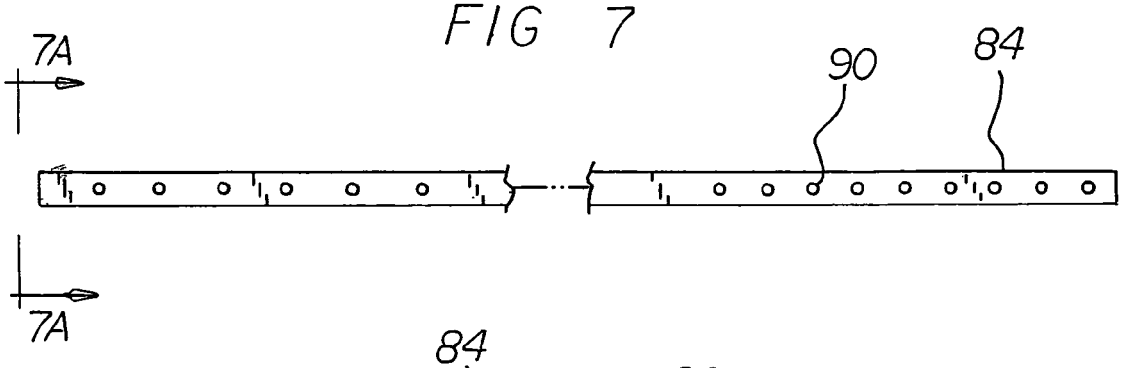
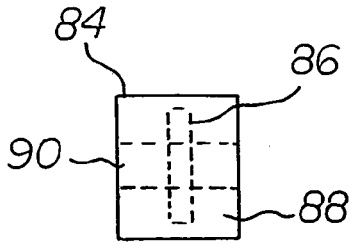
FIG 7A

FIG 10
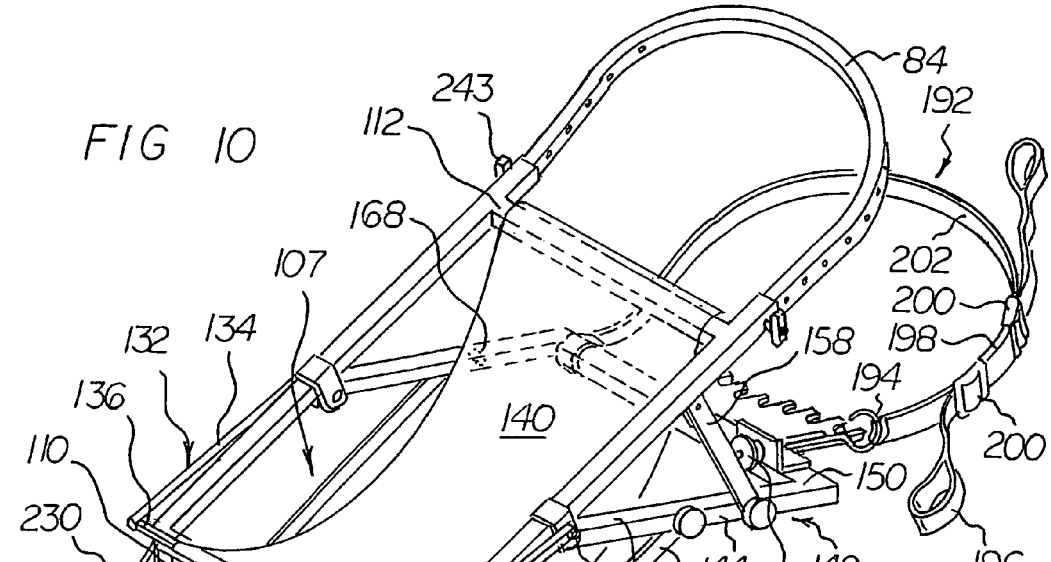
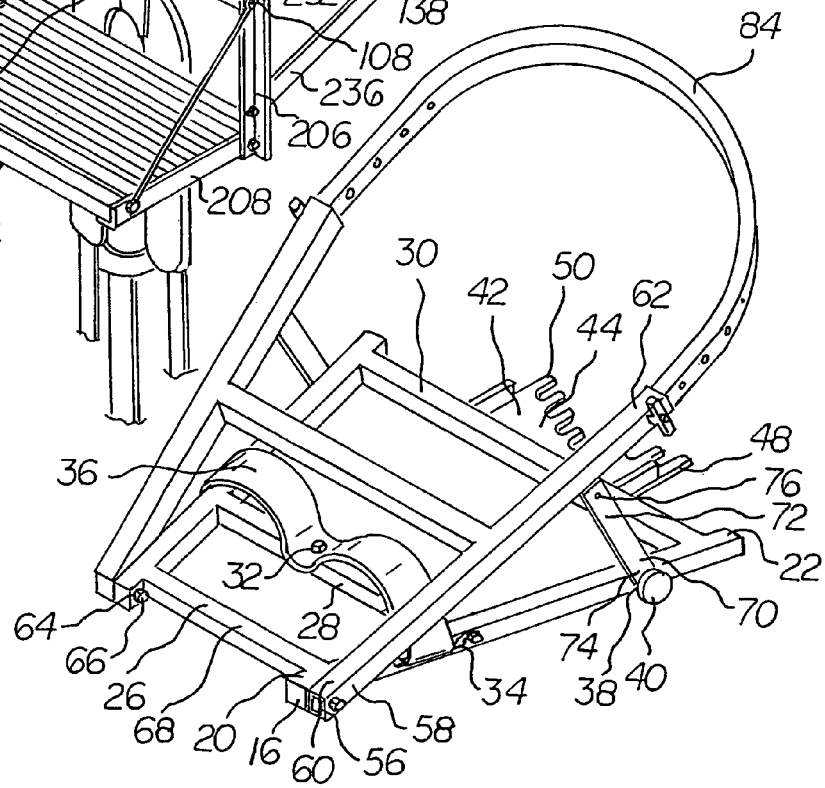
FIG 11

TREE CLIMBING TREE STAND

RELATED APPLICATIONS

This application is based upon a provision application, filed on Aug. 2, 2007, which is still pending. This application claims the priority of the referenced provisional patent application.

NEW RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a Tree Climbing Tree Stand and more particularly pertains to a device for safely climbing a tree, and sitting therein.

2. Description of the Prior Art

The use of tree stands is known in the prior art. More specifically, tree stands previously devised and utilized for the purpose of climbing a tree to take up a vantage point thereon are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe Tree Climbing Tree Stand that allows a device for safely climbing a tree, and sitting therein.

In this respect, the Tree Climbing Tree Stand according to the present invention substantially departs from the conventional concepts and designs of the prior art, and in doing so provides an apparatus primarily developed for the purpose of a device for safely climbing a tree, and sitting therein.

Therefore, it can be appreciated that there exists a continuing need for a new and improved Tree Climbing Tree Stand which can be used for safely climbing a tree, and sitting therein. In this regard, the present invention substantially fulfills this need.

SUMMARY OF THE INVENTION

In view of the foregoing disadvantages inherent in the known types of tree stands now present in the prior art, the present invention provides an improved tree climbing tree stand. As such, the general purpose of the present invention, which will be described subsequently in greater detail, is to provide a new and improved tree climbing tree stand and method which has all the advantages of the prior art and none of the disadvantages.

To attain this, the present invention essentially comprises a tree climbing tree stand comprising several components, in combination.

There is first provided a lower foot portion. The lower foot portion has two angled base shafts. The base shafts are each fabricated of a rigid aluminum, one inch square, hollow tubing the tubing has an inside surface and an outside surface with a wall thickness there between. The wall thickness of the base shafts is between about one-sixteenth of an inch and one-half of an inch in thickness.

The base shafts each have an inner end and an outer end. The inner end of the base shafts have a distance of between about six inches and twelve inches between the base shafts. The outer end of the base shafts have a distance of between about twelve inches and thirty inches between the outer end of the base shafts. The inner end of the base shafts each have a swing arm bolt hole there through.

The base shafts are coupled to each other with three base shaft cross members. The base shaft cross members are referred to as an inner cross member, a middle cross member, and an outer cross member. The cross members are all fabricated of a one inch square, hollow tubing. The base shaft cross members all have an inside surface, an outside surface, and a wall thickness there between. The wall thickness of the base shafts is between about one-sixteenth of an inch and one-half of an inch in thickness. The inner cross member is about ten inches in length. The middle cross member is about twelve inches in length. The outer base cross member is about eighteen inches in length.

The middle base cross member has a foot strap fixing location with an associated foot strap. The foot strap is coupled to each base shaft, and the foot strap is fixedly coupled to the middle cross member thereby forming a pair of generally parallel foot loops. The foot strap is about two inches in width and between about fifteen and thirty inches in length.

Each base member also has an attachment stud and an associated finger nut. The finger nut, as used in this application is a threaded core for receiving a threaded bolt. The core is encased in a plastic grip, with large knurles for gripping and easily turning the nut. Such a configuration is commonly found in devices that call for easy, tool-less, assembly and disassembly.

As such, the finger nuts, as described herein, each have an enlarged plastic head with large recesses for easy gripping by a user's fingers.

The outer base cross member has a lower tree gripper. The lower tree gripper has a generally planer configuration and is fabricated of a hard aluminum. The lower tree gripper has an outer edge and an inner edge and two opposing side edges. The inner edge of the lower tree gripper is fixedly attached to the outer base cross member. The lower tree gripper is about nine inches in length, between its side edges. The lower tree gripper has a width of about three inches, between the inner and outer edges of the lower tree gripper.

The lower tree gripper has a generally curved plurality of tree gripping teeth. The lower tree gripper has an upper surface and a lower surface, with a thickness there between. The thickness of the lower tree gripper is about one-quarter of an inch. The outer and middle base cross members have a pair of generally parallel cross member attaching members fixedly coupling the outer base cross member and the middle base cross member.

The lower foot portion also comprises a swing arm, comprising swing arm shafts. The swing arm shafts are each fabricated of a rigid aluminum, one inch square, hollow tubing. The tubing has an inside surface and an outside surface, with a wall thickness there between. The wall thickness of the swing arm shafts is between about one-sixteenth of an inch and one-half of an inch in thickness.

Each swing arm shaft has a inner end and an outer end. The inner ends of the swing arm shafts have a distance of between about six inches and twelve inches between the inner end of the swing arm shafts. The outer end of the swing arm shafts have a distance of between about twelve inches and thrity inches between the outer ends of the swing arm shafts.

The inner end of the swing arm shafts each have a swing arm bolt hole there through, with a pair of associated swing arm bolts. Each bolt rotatably couples an inner base shaft with an inner swing arm shaft. The swing arm shafts are coupled to each other with a swing arm shaft cross member.

Each swing arm shaft outer end has a flexible strap pin hole there through.

The swing arm shafts are each coupled to one of the base shafts by a swing arm-base coupling strip. The coupling strip is fabricated of a rigid aluminum. Each of the coupling strips is between about eight inches and twelve inches in length. Each of the coupling strips has a width of about one inch, and a thickness of about one-eighth inch. The coupling strip each have a swing arm end and a base shaft end. The swing arm end of each of the coupling strips has a rivet hole there through, with there being an associated rivet. The base shaft end of the coupling strip has a stud hole there through. The coupling strips are located generally between the middle base cross member and outer base cross member, with each of the coupling strips attaching to the swing arm with a rivet in a location between about six inches and eight inches from the outer end of the swing arm.

The swing arm cross member is each fabricated of a one inch square, hollow aluminum tubing. The swing arm cross member has an inside surface and an outside surface, with a wall thickness there between. The wall thickness of the swing arm cross members is between about one-sixteenth of an inch and one-half of an inch in thickness.

The swing arm cross member is about twelve inches in length.

The lower foot portion also comprises a lower flexible tree strap. The lower flexible tree strap has a spring steel strip core, with the spring steel core being enclosed between two layers of a resilient urethane material. The lower flexible tree strap has an upper surface, a lower surface, two side surfaces, and two opposing ends with a length there between. The lower flexible tree strap is generally uniform throughout its length, with a spring steel strip is about thee-quarters of an inch wide and about thirty six inches long. The spring steel strip has a thickness of between about one thirty-second of an inch and one eighth of an inch. A pair of urethane layers are coupled to the spring steel strip, and cover the strip. The lower flexible tree strap has a plurality of pin holes in both ends of the strap, with the holes being about one and one-half inches apart, center to center, with the holes running a length of between about eight and eighteen inches from each of the ends of the flexible tree strap. The lower flexible tree strap has an associated detent pin, with the detent pin being configured to pin the strap within the hollow tubing of the swing arm, using the flexible strap pin hole of the swing arm outer end.

The tree climbing tree stand also comprising an upper portion. The upper portion comprises a pair of long members. The long members are each fabricated of a rigid aluminum, one inch square, hollow tubing. The tubing has an inside surface and an outside surface, with a wall thickness there between. The wall thickness of the long members being between about one-sixteenth of an inch and one-half inch in thickness. The long members each have a inner end and an outer end. The inner ends of the long members each have a distance of between about fifteen inches and twenty eight inches between the long members. The long members each have a center point defining an equal distance from the center point to the opposing ends of the long members. The long members are oriented generally parallel with each other, and having the same general dimensions, with each long member having a length of between about twenty eight inches and forty inches. The configuration of the long members, including the long member cross pieces, form a generally rectangular body passageway through the upper portion. The long member body passageway is an area of between about fifteen inches and twenty eight inches by between about twenty eight inches and thirty eight inches.

The inner ends of the long members each have a vertical support bolt hole there through. The long members are each fixedly coupled to each other with an inner long member cross piece fixedly coupling the inner ends of the long members. An outer long member cross piece fixedly couples the outer ends of the long members to each other. The inner and outer long member cross pieces are fabricated of a rigid aluminum, one inch square, hollow tubing. The tubing has an inside surface and an outside surface, with a wall thickness there between. The wall thickness of the long member cross pieces is between about one-sixteenth of an inch and one-half of an inch in thickness. The long member cross pieces each have a pair of opposing ends with a length there between.

Each of the long members having a long strut hole there through, with an associated long strut stud and long strut finger nut. Each long member has a hammock mount hole located near the general center of the long member length. Each hammock mount hole has an associate hammock mount. The hammock mount has a generally planar configuration with a length of about two inches, a width of about one inch, and a thickness of between about three thirty-seconds of an inch and one quarter of an inch. Each hammock mount has a long member end, with a long member hole and an upper tree engaging end, with a tree engager hole.

The upper portion also comprises a hammock. The hammock is fabricated of one half of an inch square aluminum tubing. The hammock has a pair of generally parallel supports and a hammock cross member. The hammock cross member couples the two hammock supports in a general U-shaped configuration. The U-shape has an open end and a closed end. The open end of the U-shaped hammock is rotatably coupled to the hammock mount by a pair of associated hammock mount bolts.

The hammock also comprises a length of netting. The netting comprising a sheet, having a length of between about twenty four inches and forty inches. The netting has a width of between about fifteen inches and twenty four inches. The netting has opposing ends, with the opposing ends of the netting each being coupled to the hammock cross member and to the long member inner cross piece thereby forming a sling shaped configuration of the netting there between.

The upper portion also comprises a tree engager. The tree engager has a pair of generally U-shaped configuration comprising a pair of parallel connecting members and a connecting member cross member. The connecting members are each similarly constructed and have similar dimensions, each having an inner end and each having an outer end, with a length of between about twelve inches and twenty eight inches.

The connecting member cross member is located generally perpendicular to both connecting members. The connecting member cross member is made of the same material as the connecting members. The connecting members and cross member are fabricated of a rigid aluminum, one inch square, hollow tubing. The tubing has an inside surface and an outside surface with a wall thickness there between. The wall thickness of the connecting members and connecting member cross member is between about one-sixteenth of an inch and one-half of an inch in thickness. The connecting member cross member has a length, with opposing ends. The connecting member cross member has an inner edge, an outer edge, a top edge, and a bottom edge. Each connecting member inner end is rotatably coupled to the hammock mount by an associated bolt passing through a connecting member inner end bolt hole and the tree engager bolt hole of the hammock mount.

Each connecting member has a strut stud and an associated finger nut located between about six inches and twelve inches from the outer end of the connecting member.

There is a pair of connecting member struts. Each connecting member strut is fabricated of a fabricated of a rigid aluminum and is between about eight inches and twelve inches in length. Each connecting member strut has a width of about one inch, and a thickness of about one-eighth of an inch. Each connecting member strut has a long member end and a coupling member end. The long member end of the connecting member strut has a rivet hole there through, with there also being an associated rivet. The connecting member end of the strut has a stud hole there through.

The connecting member cross member fixedly couples the outer ends of the connecting members, so as to form the U-shaped configuration.

The connecting member cross member has an upper tree gripper coupled there to. The upper tree gripper has a generally planer configuration and is fabricated of a hard aluminum. The upper tree gripper has an outer edge, an inner edge, and two opposing side edges. The inner edge of the upper tree gripper is fixedly attached to the outer edge of the connecting member cross member. The upper tree gripper is about nine inches in length between the side edges, and has a width of about three inches between the inner and outer edges of the upper tree gripper. The upper tree gripper has a generally curved plurality of tree gripping teeth. The upper tree gripper has an upper surface and a lower surface, with a thickness there between. The thickness of the upper tree gripper is about one-quarter of an inch.

The connecting member cross member has a hook hole there through with an associated hook. The hook has a smooth hook end and a threaded end. The threaded end has an associated finger nut. The hook hole is located through the connecting member cross member, in a plane which is angled toward the end of the outer edge of the connecting member cross member. The hook hole is located adjacent the tree gripper and is angled away from the tree gripper.

The connecting member cross member also has an associated tree trunk attachment strap. The tree trunk attachment strap is fabricated of a flexible, water resistant and tear resistant fabric. The strap being about three-fourths of an inch in width and between about one sixteenth of an inch and three sixteenths of an inch in thickness. The strap comprises an inner strap having a cross member attachment loop and a looped gripping end. The strap also has a central attachment, comprising a pair of strap grips coupled fixedly together, with the inner strap passing through a first strap grip. The strap also has an outer strap. The outer strap has a configuration similar to the inner strap. The outer strap passes through a second strap grip, which is fixedly coupled to the first strap grip.

The upper portion also comprises a foot rest. The foot rest has a pair of vertical legs, a pair of horizontal legs, and a plurality of foot platform supports. The vertical legs and horizontal legs are each made of a one inch angle aluminum, having a length of between about twelve and twenty inches.

Each of the vertical supports have a long member end, with a long member coupling bolt hole and an associated long member bolt. The long member bolts rotatably coupling the long member ends of the vertical supports to the inner ends of the long members. Each of the vertical supports has a foot platform end, with a foot platform bolt hole and an associated foot platform bolt.

The horizontal members each have an attachment end and a free end. The attachment end of each of the horizontal supports has a hole configured to receive the foot platform bolt, so as to rotatably couple each of the horizontal members to the foot platform end of each of the vertical members.

The foot platform supports of the foot rest are fabricated of a three-fourths of an inch square, aluminum hollow tubing. The foot platform supports of the foot rest each have a pair of opposing ends and a length there between. The opposing ends of the plurality of foot supports are fixedly coupled to each of the horizontal supports.

The foot rest also comprises a pair of stop cables, with each stop cable being similarly configured and having a diameter of between about one sixteenth of an inch and one quarter of an inch. Each of the stop cables have opposing ends and a length of between about fifteen inches and twenty five inches. The opposing ends of each of the stop cables are coupled to the long member ends of the vertical supports and the free ends of the horizontal supports, so as to limit the rotation of the horizontal supports relative to the vertical supports.

The foot rest also comprises a pair of similarly configured long struts, with each long strut being fabricated of three fourths of an inch angle. Each of the long struts has a long member end and a vertical support end, with a length of between about sixteen inches and thirty inches. Each of the long member ends of the struts have a long member coupling hole there through, for removably coupling each of the long struts to one of the long members using the long strut stud and long strut finger nuts of the long members. Each of the vertical support end ends of the struts has a vertical support end coupling hole there through, for rotatably coupling each of the long struts to one of the vertical supports.

The upper portion also utilizes a flexible tree strap, referred to as the upper flexible tree strap. The upper flexible tree strap and lower flexible tree strap are generally identical in size, shape and configuration. A description of one is the description of the other. The upper flexible tree strap has opposing ends and the opposing ends are slipped into the outer ends of the long members, and pinned there using the detent pins located at the ends of the long members.

Lastly, there is a carry harness. The carry harness comprises a pair of first shoulder straps. Each of the first shoulder straps has a cross piece end. The cross piece end is coupled to the inner long member cross piece of the upper portion.

The shoulder straps also has a free end. The free end has a removable fastener attached there to. The carry harness also comprises a second strap having two free ends. The second strap comprises a length of strap having a centrally located attachment for a third strap. The free ends of the second strap are removably couplable to the shoulder strap removable fastener, with the free ends of the second strap having an adjustment means to allow the second strap to have an operative length.

The third strap has a pair of ends. The third strap has an adjustment means to allow the third strap to have an operative length. The third strap has a pair of ends, with each end having a coupling component fastened there to. The coupling components allowing for the adjustment of the operative length of the third strap.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tree climbing tree stand which has all of the advantages of the prior art tree stands and none of the disadvantages.

It is another object of the present invention to provide a new and improved tree climbing tree stand which may be easily and efficiently manufactured and marketed.

It is further object of the present invention to provide a new and improved tree climbing tree stand which is of durable and reliable constructions.

An even further object of the present invention is to provide a new and improved tree climbing tree stand which is susceptible of a low cost of manufacture with regard to both materials and labor, and which accordingly is then susceptible of low prices of sale to the consuming public, thereby making such tree climbing tree stand economically available to the buying public.

Even still another object of the present invention is to provide a tree climbing tree stand for a device for safely climbing a tree, and sitting therein.

Lastly, it is an object of the present invention to provide a new and improved tree climbing tree stand comprising, in combination a lower foot portion. The lower foot portion has a lower flexible tree strap coupled there to. There is also provided an upper portion. The upper portion has an upper flexible tree strap coupled there to.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevation of the upper portion of the tree stand.

FIG. 3 is a view taken along line 3-3 of FIG. 2, showing a top view of the upper portion of the tree climbing tree stand.

FIG. 6 is a view taken along line 6-6 of FIG. 5. Note the foot loops in phantom.

FIG. 7 is a side view of the flexible strap. The two flexible straps used are generally identical in size, shape, and configuration.

FIG. 7A is a view taken along line 7A-7A of FIG. 7, showing the spring steel inner band, covered by a urethane coating. The spring steel provides the strength, and the urethane coating provides a slip resistant surface, as well as a covering of the metal, protecting the metal from the elements.

FIGS. 10 and 11 respectively depict perspective views of the upper and lower portions of the tree climbing tree stand.

The same reference numerals refer to the same parts throughout the various Figures.

DESCRIPTION OF THE PREFERRED EMBODIMENT

Figure 1:
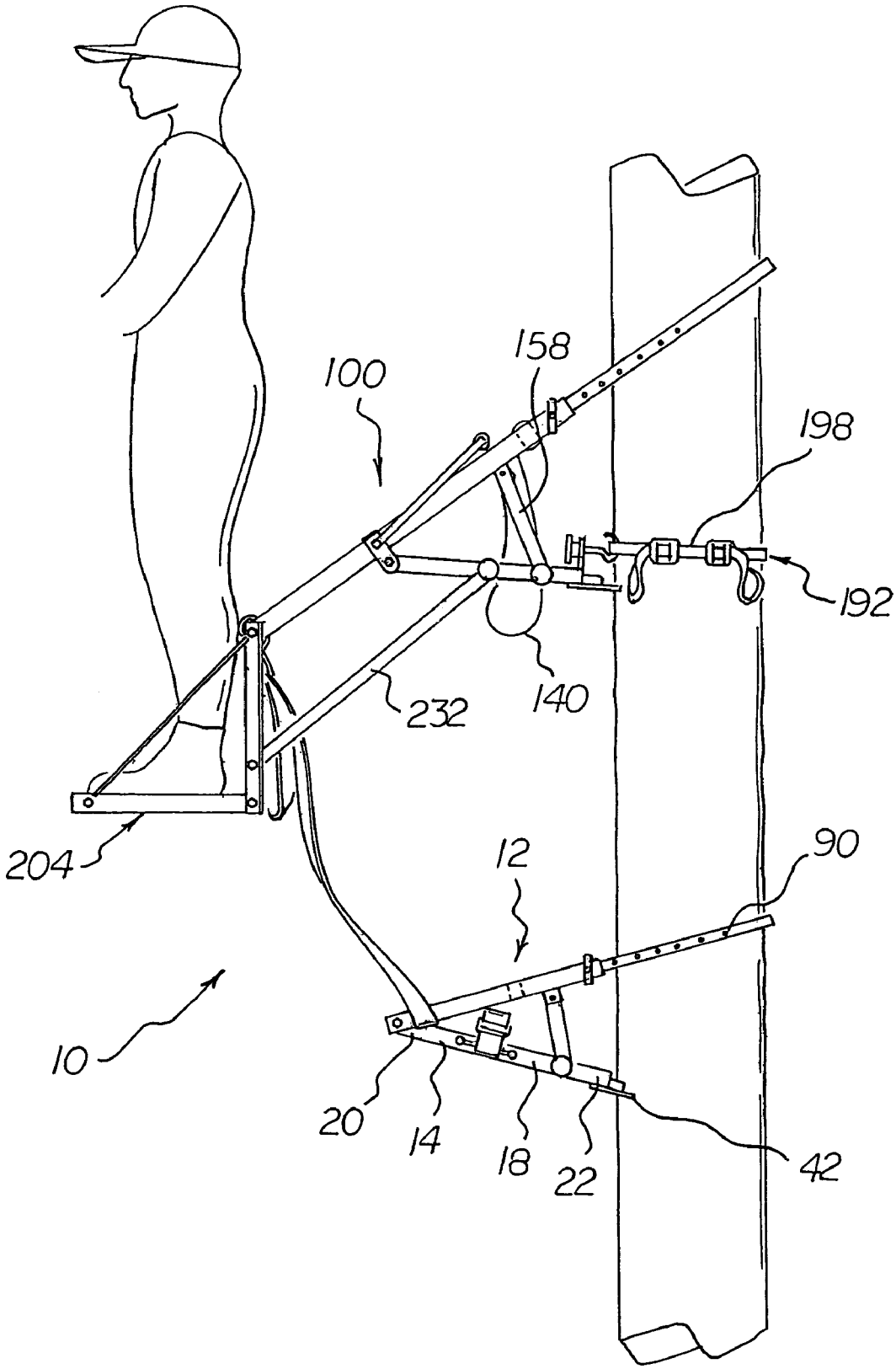
FIG. 1 is side elevation of a user standing on the foot rest of the tree climbing tree stand. Note the tree attachment strap #192 holding the stand fast against the tree trunk.
Figure 4:
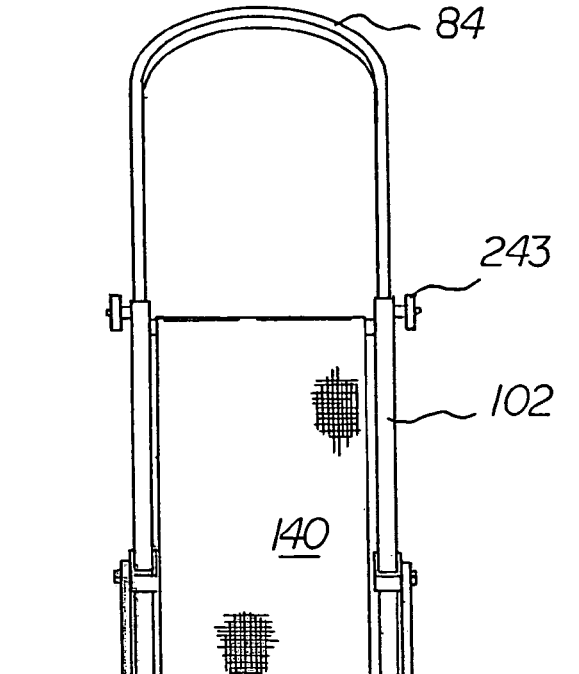
FIG. 4 is a top view of the tree stand, showing the carrying harness in place.
Figure 5:
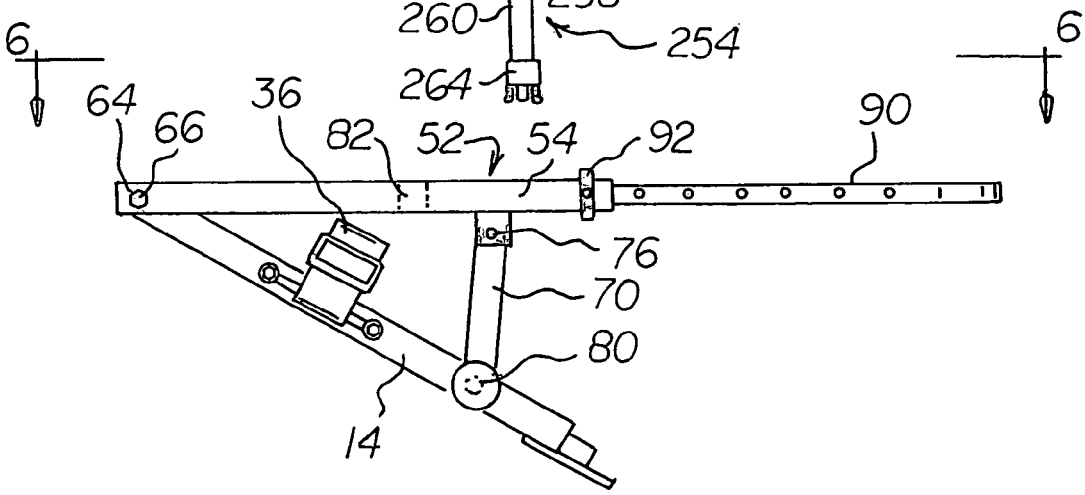
FIG. 5 is a side elevation of the lower portion of the tree stand.
Figure 8:
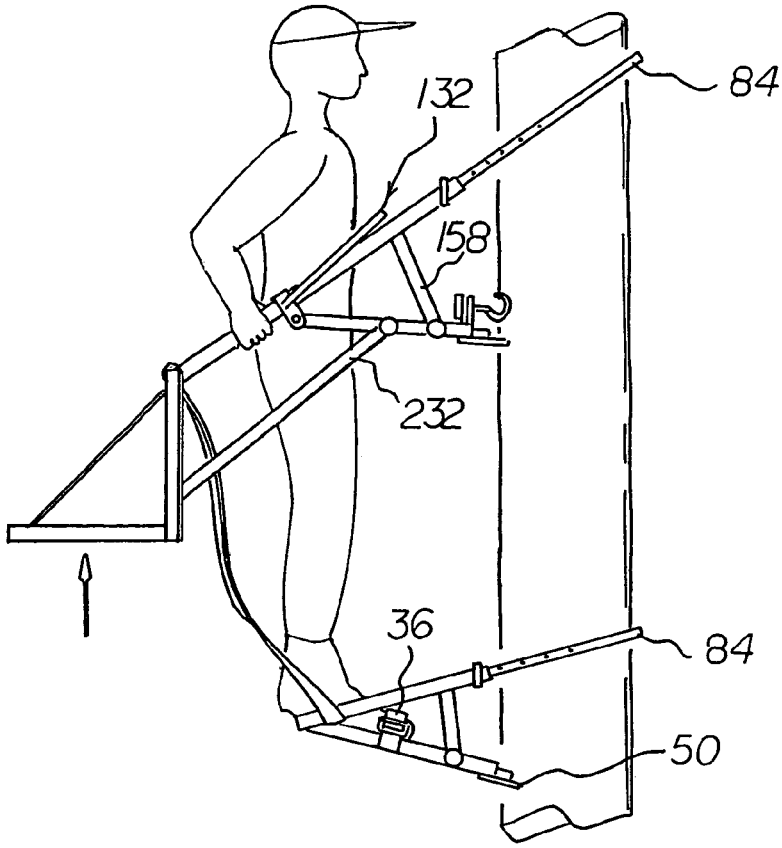
FIG. 8 shows a user preparing to pull up the lower foot portion with the user's feet.
Figure 9:
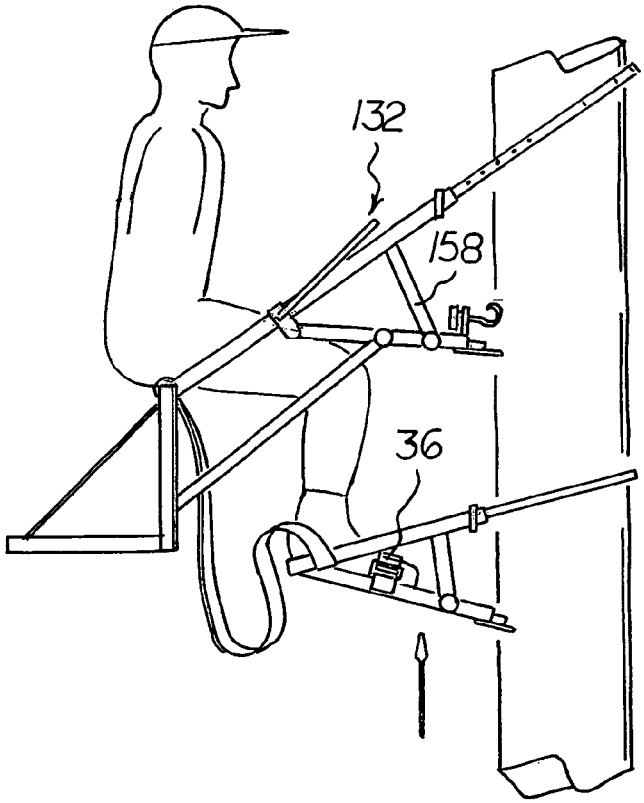
FIG. 9 shows the user having pulled up the lower foot portion with his feet, and the user sitting on the inner corss member of the upper portion long members. Note that the tree attachment strap is not utilized, until the climbing is completed.

With reference now to the drawings, and in particular to FIG. 1 thereof, the preferred embodiment of the new and improved Tree Climbing Tree Stand embodying the principles and concepts of the present invention and generally designated by the reference numeral 10 will be described.

The present invention, the tree climbing tree stand 10 is comprised of a plurality of components. Such components in their broadest context include a lower portion, an upper portion, a foot platform and a pair of flexible tree straps. Such components are individually configured and correlated with respect to each other so as to attain the desired objective.

A tree climbing tree stand 10 comprising several components, in combination.

There is first provided a lower foot portion 12. The lower foot portion has two angled base shafts 14. The base shafts are each fabricated of a rigid aluminum, one inch square, hollow tubing the tubing has an inside surface 16 and an outside surface 18 with a wall thickness there between. The wall thickness of the base shafts is between about one-sixteenth of an inch and one-half of an inch in thickness.

The base shafts each have an inner end 20 and an outer end 22. The inner end of the base shafts have a distance of between about six inches and twelve inches between the base shafts. The outer end of the base shafts have a distance of between about twelve inches and thirty inches between the outer end of the base shafts. The inner end of the base shafts each have a swing arm bolt hole 24 there through.

The base shafts are coupled to each other with three base shaft cross members. The base shaft cross members are referred to as an inner cross member 26, a middle cross member 28, and an outer cross member 30. The cross members are all fabricated of a one inch square, hollow tubing. The base shaft cross members all have an inside surface, an outside surface, and a wall thickness there between. The wall thickness of the base shafts is between about one-sixteenth of an inch and one-half of an inch in thickness. The inner cross member is about ten inches in length. The middle cross member is about twelve inches in length. The outer base cross member is about eighteen inches in length.

The middle base cross member has a foot strap 32 fixing location with an associated foot strap 34. The foot strap is coupled to each base shaft, and the foot strap is fixedly coupled to the middle cross member thereby forming a pair of generally parallel foot loops 36. The foot strap is about two inches in width and between about fifteen and thirty inches in length.

Each base member also has an attachment stud 38 and an associated finger nut 40. The finger nut, as used in this application is a threaded core for receiving a threaded bolt. The core is encased in a plastic grip, with large knurles for gripping and easily turning the nut. Such a configuration is commonly found in devices that call for easy, tool-less, assembly and disassembly.

In other embodiments any releasable attachment means may be used. Such attachments means include nut and bolt combinations, snaps, detents, slide and ball couplers, slip couplers, pins, clips, wires, ties and hooks.

As such, the finger nuts, as described herein, each have an enlarged plastic head with large recesses for easy gripping by a user's fingers.

The outer base cross member has a lower tree gripper 42. The lower tree gripper has a generally planer configuration and is fabricated of a hard aluminum. The lower tree gripper has an outer edge 44 and an inner edge 46 and two opposing side edges 48. The inner edge of the lower tree gripper is fixedly attached to the outer base cross member. The lower tree gripper is about nine inches in length, between its side edges. The lower tree gripper has a width of about three inches, between the inner and outer edges of the lower tree gripper.

The lower tree gripper has a generally curved plurality of tree gripping teeth 50. The lower tree gripper has an upper surface and a lower surface, with a thickness there between. The thickness of the lower tree gripper is about one-quarter of an inch. The outer and middle base cross members have a pair of generally parallel cross member attaching members 51 fixedly coupling the outer base cross member and the middle base cross member.

The lower foot portion also comprises a swing arm 52, comprising swing arm shafts 54. The swing arm shafts are each fabricated of a rigid aluminum, one inch square, hollow tubing. The tubing has an inside surface 56 and an outside surface 58, with a wall thickness there between. The wall thickness of the swing arm shafts is between about one-sixteenth of an inch and one-half of an inch in thickness.

Each swing arm shaft has a inner end 60 and an outer end 62. The inner ends of the swing arm shafts have a distance of between about six inches and twelve inches between the inner end of the swing arm shafts. The outer end of the swing arm shafts have a distance of between about twelve inches and thirty inches between the outer ends of the swing arm shafts.

The inner end of the swing arm shafts each have a swing arm bolt hole there through 64, with a pair of associated swing arm bolts 66. Each bolt rotatably couples an inner base shaft with an inner swing arm shaft. The swing arm shafts are coupled to each other with a swing arm shaft cross member 68.

The swing arm shafts are each coupled to one of the base shafts by a swing arm-base coupling strip 70. The coupling strip is fabricated of a rigid aluminum. Each of the coupling strips is between about eight inches and twelve inches in length. Each of the coupling strips has a width of about one inch, and a thickness of about one-eighth inch. The coupling strip each have a swing arm end 72 and a base shaft end 74. The swing arm end of each of the coupling strips has a rivet hole there through, with there being an associated rivet 76. The base shaft end of the coupling strip has a stud hole 80 there through. The coupling strips are located generally between the middle base cross member and outer base cross member, with each of the coupling strips attaching to the swing arm with a rivet in a location between about six inches and eight inches from the outer end of the swing arm.

Each swing arm shaft outer end has a flexible strap pin hole 81 there through.

The swing arm has a stabilizing swing arm cross member 82. The swing arm cross member is fabricated of a one inch square, hollow aluminum tubing, and has two opposing end with a length there between. The swing arm cross member has an inside surface and an outside surface, with a wall thickness there between. The wall thickness of the swing arm cross members is between about one-sixteenth of an inch and one-half of an inch in thickness. The swing arm cross member is about twelve inches in length.

The lower foot portion also comprises a first lower flexible tree strap 84. The lower flexible tree strap has a first spring steel strip core 86, with the first spring steel core being enclosed between two layers of a resilient urethane material 88. The first lower flexible tree strap has an upper surface, a lower surface, two side surfaces, and two opposing ends with a length there between. The lower flexible tree strap is generally uniform throughout its length, with a spring steel strip being about thee-quarters of an inch wide and about thirty six inches long. The spring steel strip has a thickness of between about one thirty-second of an inch and one eighth of an inch. A pair of urethane layers are coupled to the spring steel strip, and cover the strip. The lower flexible tree strap has a plurality of pin holes 90 in both ends of the strap, with the holes being about one and one-half inches apart, center to center, with the holes running a length of between about eight and eighteen inches from each of the ends of the flexible tree strap. The first lower flexible tree strap has an associated detent pin 92, with the detent pin being configured to pin the strap within the hollow tubing of the swing arm, using the flexible strap pin hole of the swing arm outer end.

The tree climbing tree stand also comprising an upper portion 100. The upper portion comprises a pair of long members 102. The long members are each fabricated of a rigid aluminum, one inch square, hollow tubing. The tubing has an inside surface and an outside surface, with a wall thickness there between. The wall thickness of the long members being between about one-sixteenth of an inch and one-half inch in thickness. The long members each have a inner end 104 and an outer end 106, with a length there between.

The inner ends of the long members each have a distance of between about fifteen inches and twenty eight inches between the long members. The long members each have a center point defining an equal distance from the center point to the opposing ends of the long members. The long members are oriented generally parallel with each other, and having the same general dimensions, being generally mirror images of one another, with each long member having a length of between about twenty eight inches and forty inches. The configuration of the long members, including the long member cross pieces, form a generally rectangular body passageway through the upper portion. The long member body passageway 107 is an area of between about fifteen inches and twenty eight inches by between about twenty eight inches and thirty eight inches.

The inner ends of the long members each have a vertical support bolt hole 108 there through. The long members are each fixedly coupled to each other with an inner long member cross piece 110 fixedly coupling the inner ends of the long members. An outer long member cross piece 112 fixedly couples the outer ends of the long members to each other. The inner and outer long member cross pieces are fabricated of a rigid aluminum, one inch square, hollow tubing. The tubing has an inside surface and an outside surface, with a wall thickness there between. The wall thickness of the long member cross pieces is between about one-sixteenth of an inch and one-half of an inch in thickness.

Each long member has a hammock mount hole 120 located near the general center of the long member length. Each hammock mount hole has an associate hammock mount 122. The hammock mount has a generally planar configuration with a length of about two inches, a width of about one inch, and a thickness of between about three thirty-seconds of an inch and one quarter of an inch. Each hammock mount has a long member end 124, with a long member hole 126 and an upper tree engaging end 128, with a tree engager hole 130.

The upper portion also comprises a hammock 132. The hammock is fabricated of one half of an inch square aluminum tubing. The hammock has a pair of generally parallel supports 134 and a hammock cross member 136. The hammock cross member couples the two hammock supports in a general U-shaped configuration. The U-shape has an open end and a closed end. The open end of the U-shaped hammock is rotatably coupled to the hammock mount by a pair of associated hammock mount bolts 138.

The hammock also comprises a length of netting 140. The netting comprising a sheet, having a length of between about twenty four inches and forty inches. The netting has a width of between about fifteen inches and twenty four inches. The netting has opposing ends, with the opposing ends of the netting each being coupled to the hammock cross member and to the long member outer cross piece thereby forming a sling shaped configuration of the netting there between.

The upper portion also comprises a tree engager 142. The tree engager has a pair of generally U-shaped configuration comprising a pair of parallel connecting members 144 and a connecting member cross member 146. The connecting members are each similarly constructed and have similar dimensions, each having an inner end 148 and each having an outer end 150, with a length of between about twelve inches and twenty eight inches.

The connecting member cross member is located generally perpendicular to both connecting members. The connecting member cross member is made of the same material as the connecting members. The connecting members and cross member are fabricated of a rigid aluminum, one inch square, hollow tubing. The tubing has an inside surface and an outside surface with a wall thickness there between. The wall thickness of the connecting members and connecting member cross member is between about one-sixteenth of an inch and one-half of an inch in thickness.

The connecting member cross member has a length, with opposing ends. The connecting member cross member has an inner edge, an outer edge 152, a top edge, and a bottom edge. Each connecting member inner end is rotatably coupled to the hammock mount by an associated bolt 154 passing through a connecting member inner end bolt hole and the tree engager bolt hole of the hammock mount.

Each connecting member has a strut stud 156 and an associated finger nut located between about six inches and twelve inches from the outer end of the connecting member.

There is a pair of connecting member struts 158. Each connecting member strut is fabricated of a fabricated of a rigid aluminum and is between about eight inches and twelve inches in length. Each connecting member strut has a width of about one inch, and a thickness of about one-eighth of an inch. Each connecting member strut has a long member end 160 and a coupling member end 162. The long member end of the connecting member strut has a rivet hole with a rivet 164 there through. The connecting member end of the strut has a stud hole 168 there through.

The connecting member cross member fixedly couples the outer ends of the connecting members, so as to form the U-shaped configuration.

The connecting member cross member has an upper tree gripper 170 coupled there to. The upper tree gripper has a generally planer configuration and is fabricated of a hard aluminum. The upper tree gripper has an outer edge 172, an inner edge 174, and two opposing side edges 176. The inner edge of the upper tree gripper is fixedly attached to the outer edge of the connecting member cross member. The upper tree gripper is about nine inches in length between the side edges, and has a width of about three inches between the inner and outer edges of the upper tree gripper. The upper tree gripper has a generally curved plurality of tree gripping teeth 178. The upper tree gripper has an upper surface and a lower surface, with a thickness there between. The thickness of the upper tree gripper is about one-quarter of an inch.

The connecting member cross member has a hook hole 180 there through with an associated hook 182. The hook has a smooth hook end 184 and a threaded end 186. The threaded end has an associated finger nut 188. The hook hole is located through the connecting member cross member, in a plane which is angled toward the end of the outer edge of the connecting member cross member. The hook hole is located adjacent the tree gripper and is angled away from the tree gripper.

The connecting member cross member also has an associated tree trunk attachment strap 190. The tree trunk attachment strap is fabricated of a flexible, water resistant and tear resistant fabric. The strap being about three-fourths of an inch in width and between about one sixteenth of an inch and three sixteenths of an inch in thickness. The strap comprises an inner strap 192 having a cross member attachment loop 194 and a looped gripping end 196. The strap also has a central attachment 198, comprising a pair of strap grips 200 coupled fixedly together, with the inner strap passing through a first strap grip. The strap also has an outer strap 202. The outer strap has a configuration similar to the inner strap. The outer strap passes through a second strap grip, which is fixedly coupled to the first strap grip.

The upper portion also comprises a foot rest 204. The foot rest has a pair of vertical legs 206, a pair of horizontal legs 208, and a plurality of foot platform supports 210. The vertical legs and horizontal legs are each made of a one inch angle aluminum, having a length of between about twelve and twenty inches.

Each of the vertical supports have a long member end 212, with a long member coupling bolt hole 214 and an associated long member bolt 216. The long member bolts rotatably coupling the long member ends of the vertical supports to the inner ends of the long members. Each of the vertical supports has a foot platform end 218, with a foot platform bolt hole 220 and an associated foot platform bolt 222.

The horizontal members each have an attachment end 224 and a free end 226. The attachment end of each of the horizontal supports has a hole 228 configured to receive the foot platform bolt, so as to rotatably couple each of the horizontal members to the foot platform end of each of the vertical members.

The foot platform supports of the foot rest are fabricated of a three-fourths of an inch square, aluminum hollow tubing. The foot platform supports of the foot rest each have a pair of opposing ends and a length there between. The opposing ends of the plurality of foot supports are fixedly coupled to each of the horizontal supports.

The foot rest also comprises a pair of stop cables 230, with each stop cable being similarly configured and having a diameter of between about one sixteenth of an inch and one quarter of an inch. Each of the stop cables have opposing ends and a length of between about fifteen inches and twenty five inches. The opposing ends of each of the stop cables are coupled to the long member ends of the vertical supports and the free ends of the horizontal supports, so as to limit the rotation of the horizontal supports relative to the vertical supports.

The foot rest also comprises a pair of similarly configured long struts 232, with each long strut being fabricated of three fourths of an inch angle. Each of the long struts has a long member end 234 and a vertical support end 236, with a length of between about sixteen inches and thirty inches. Each of the long member ends of the struts have a long member coupling hole 238 there through, for removably coupling each of the long struts to one of the long members using the long strut stud 240 and long strut finger nuts 242 of the long members. Each of the vertical support end ends of the struts has a vertical support end coupling hole there through, for rotatably coupling each of the long struts to one of the vertical supports.

The upper portion also comprises a second upper flexible tree strap which is the same as item #84, the lower portion flexible tree strap. There are, therefore, a pair of flexible tree straps, identified as item #84. The upper flexible tree strap has a second spring steel strip and an associated detent pin 243, with the detent pin being configured to pin the strap within the hollow tubing of the swing arm, using the flexible strap pin hole of the swing arm outer end.

Lastly, there is a carry harness 244. The carry harness comprises a pair of first shoulder straps 246. Each of the first shoulder straps has a cross piece end 248. The cross piece end is coupled to the inner long member cross piece of the upper portion.

The shoulder straps also has a free end 250. The free end has a removable fastener 252 attached there to. The carry harness also comprises a second strap 254 having two free ends 256. The second strap comprises a length of strap having a centrally located attachment 258 for a third strap 260. The free ends of the second strap are removably couplable to the shoulder strap removable fastener, with the free ends of the second strap having an adjustment means 262 to allow the second strap to have an operative length.

The third strap has a pair of ends. The third strap has an adjustment means 264 to allow the third strap to have an operative length. The third strap has a pair of ends, with each end having a coupling component 266 fastened there to. The coupling components allowing for the adjustment of the operative length of the third strap.

The operation of the tree climbing tree stand is as follows. A user packs the stand in a folded, not shown, configuration. At the site of deployment, the user loosens the shoulder harness and lays the tree stand on the ground, or other surface. The user removes the lower portion from the pack and sets that aside. The user then extends the foot rest until the stop cables do not allow any further increase in angle between the vertical supports and the horizontal supports. The user then pivots each of the long struts until the long member hole in the long struts aligns with the studs in the long members. The user then slips the long struts on to the studs and fastens each of the long struts in place using the finger nuts provided. This assembly locks the foot rest in position.

The user then rotates the upper portion tree engager away from the long members and rotates the connecting member struts until the hole in the engager end of connecting member struts is aligned with the studs on the engager. The connecting member struts are then locked in place using the finger nuts provided with the studs.

The hammock is rotated so that it is in the non-deployed position, being rotated out of the passageway between the long members. The upper flexible tree strap detent pin is removed from one end of the upper flexible tree strap and that end is placed around the tree to be climbed. The tree gripper is positioned to engaged the trunk of the tree, and the upper flexible tree strap is then reinserted into the hollow tubular long member, and pinned in place using the detent pin. The user then can lift the upper portion to a location above his, or her, head. The tree trunk attachment strap is then loosely placed around the tree trunk. This strap will be finally tightened with the stand is in the final climb-completed position.

The user then, taking the lower portion in hand, rotates the swing arm away from the base. The swing arm-base coupling strips are then rotated so as to have the hole in the coupling strip align with the stud of the swing arm. The finger nuts are used to tighten the coupling strips to the swing arm, fixedly coupling the base and the swing arm. Then one of the lower portion flexible tree strap detents is removed, and the strap opened. The lower portion is placed on the tree trunk, below the upper portion, and the lower portion flexible tree strap is then re-inserted into the hollow tubular swing arm, and pinned in place using the detent pin.

As in any tree stand use, the user must, before ascending the tree, don a safety climbing harness.

The user then moves the lower portion to a first climbing position. The user then places one foot into one of the lower portion foot straps, and positions his or her body within the body passageway of the upper portion. Using the lower portion as a step, the user lifts the upper portion, to a comfortable height. The using the upper portion to aid in lifting, the user pulls up the lower portion with his or her feet, in an "inch worm" or "incremental" movement up the tree trunk. This movement continues up the tree trunk until the user is in the desired location.

Standing on the lower portion, the user may lean into the tree, and make the final adjustments to the upper portion, such as the tightening of the tree trunk strap, using the threaded hook to tighten the strap firmly against the tree trunk. The user can then step up, through the passageway, onto the foot rest, and pull the hammock into the deployed position. The user may then be seated in the hammock.

Descending the tree requires the reversal of the above steps, and like climbing, is accomplished in a step-wise fashion.

The advantages of the present invention over the prior art is that the passageway allows the user to climb without leaning out or climbing around the device, as is done with other tree climbing tree stands. The passageway acts to keep the user on the lower portion, and within safe balance.

The hammock allows the user to be comfortable, and contained within the framework of the upper portion. One of the hazzards of the use of a tree stand is the user falling asleep while above the ground, and falling from the stand. The containment of the hammock lowers the center of gravity of the user to within the frame of the upper portion, and works to prevent sleep caused falls.

Another advantage of the present invention is use of the tree trunk attachment strap and the tightening hook, which tightens the strap around the tree trunk and prevents movement and attendant noise during use above the ground.

Lastly, the carry harness provides an easy way to pack the tree stand to remote locations. The use of the finger nuts, and rotatable struts, allows for compression of the device and easy handling, and packing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tree climbing tree stand comprising, in combination:

a lower foot portion having a first lower flexible tree strap coupled thereto;

an upper portion having a second upper flexible tree strap coupled thereto, the upper portion forming a body passageway therethrough;

the lower foot portion having two angled base shafts with each base shaft having an inner end and an outer end, the lower foot portion having an inner cross member and a middle cross member and an outer cross member, the middle base cross member having a foot strap fixing location with an associated foot strap, the associated foot strap being coupled to each of the base shafts and the associated foot strap is also fixedly coupled to the middle cross member thereby forming a pair of generally parallel foot loops, the outer base cross member having a lower tree gripper;

the base shafts being fabricated of aluminum one inch square hollow tubing, the tubing having an inside surface and an outside surface with a wall thickness therebetween, the base shafts being angled to each other, the inner end of each of the base shafts having a swing arm bolt hole therethrough;

the lower foot portion also comprising a swing arm comprising a pair of similarly configured hollow tubular swing arm shafts, each of the similarly configured hollow tubular swing arm shafts being coupled to each other with a swing arm shaft cross member, each swing arm shaft having an outer end with each swing arm shaft outer end having a flexible strap pin hole there through, the lower flexible tree strap has two opposing ends and a length therebetween, there are a plurality of pin holes in both ends of the lower flexible tree strap, the lower flexible tree strap having an associated detent pin, the lower flexible tree strap being coupled to each of the swing arm shafts by inserting the lower flexible tree strap into each of the outer ends of the hollow swing arm shafts and inserting the detent pin into a strap hole being located at the outer end of each of the swing arm shafts;

the lower tree gripper having an outer edge and an inner edge and two opposing side edges, the inner edge of the lower tree gripper being fixedly attached to the outer base cross member, the lower tree gripper outer edge having a generally curved plurality of tree gripping teeth with the lower tree gripper having an upper surface and a lower surface with a thickness therebetween;

each swing arm shaft having an inner end with the inner end of the swing arm shafts each having a swing arm bolt hole there through, with there being a pair of associated swing arm bolts, with each swing arm bolt rotatably coupling the inner base shafts with the inner swing arm shafts;

the swing arm shafts each being coupled to one of each of the base shafts by a swing arm base coupling strip, the swing arm base coupling strip having a swing arm end and a base shaft end;

the first lower flexible tree strap having an upper surface and a lower surface and two side surfaces, the lower flexible tree strap having a first end and a second end, the lower flexible tree strap having a pair of flexible material layers being coupled to a first spring steel strip with the flexible material layers enclosing the first spring steel strip;

each of the detent pins being configured to fit through the flexible strap outer end pin holes of each of the swing arms;

the upper portion comprising a pair of hollow tubular long members, the long members each having an inner end and an open outer end, the open outer end having a strap hole therethrough, the long members each being fixedly coupled to each other with an inner long member cross piece fixedly coupling the inner ends of the long members near the inner ends of each of the long members and an outer long member cross piece fixedly coupling the outer ends of the long members to each other;

the upper portion of the tree climbing tree stand having the upper flexible tree strap with the upper flexible tree strap having two opposing ends and a length therebetween, the upper flexible tree strap having a plurality of detent pin holes in both ends of the strap, the upper flexible tree strap having associated detent pins with the upper flexible tree strap being coupled to each of the long members by inserting the upper flexible tree strap into each of the hollow outer ends of the long members of the upper portion and inserting the detent pins into a strap holes being located at the outer ends of each of the upper portion long members;

each of the upper portion long member cross pieces being similarly configured, with each long member cross piece having an inner end and an outer end with a length therebetween;

the upper portion also comprising a hammock, the hammock having a pair of generally parallel supports and a hammock cross member, the hammock being rotatably coupled to a hammock mount, the hammock also comprising a length of netting forming a sling with the netting being coupled to the outer long member cross piece;

the upper portion also comprising a tree engager, the tree engager having a pair of connecting members and a connecting member cross member coupled in a generally U-shaped configuration with the tree engager connecting members each having an inner end and an outer end, the connecting member cross member having an upper tree gripper coupled thereto, the upper portion tree engager being rotatably coupled to the hammock mount by an associated bolt passing through a connecting member inner end bolt hole and a tree engager bolt hole in the hammock mount, the upper portion also comprising a pair of connecting member struts with each connecting member strut having a long member end and a coupling member end;

the upper portion also comprising a foot rest having a pair of vertical legs and a pair of horizontal legs and a plurality of foot platform supports, the foot rest also comprises a pair of similarly configured long struts with each long strut having a long member end and a vertical support end with a length therebetween;

the upper portion further comprising the long members having a length, the long members being generally parallel with each other and having the same general dimensions, the inner end of the long members each having a vertical support bolt hole therethrough, each long member having a hammock mount hole generally located near a center point of the long member length, each hammock mount hole having an associated hammock mount;

the second upper flexible tree strap having an upper surface and a lower surface and two side surfaces, the second upper flexible tree strap having a first end and a second end, a second pair of flexible material layers being coupled to a second spring steel strip and enclosing the spring steel strip;

the hammock cross member coupling the two supports in a general U shaped configuration, the U shape having an open end and a closed end;

the netting having two opposing ends, with one of the opposing ends of the netting being coupled to the hammock cross member and the other of the opposing ends of the netting being coupled to the long member outer cross piece thereby forming a sling configuration of the netting therebetween;

the connecting members of the tree engager each being similarly constructed and having similar dimensions with an inner end and an outer end, each of the connecting members having a similar length;

the tree engager being coupled to each of the upper portion long members by an associated bolt passing through the connecting member inner end bolt hole and the tree engager bolt hole of each of the hammock mounts;

the long member ends of the connecting member struts having a rivet hole therethrough with an associated rivet and the connecting member ends of the connecting member struts having a stud hole therethrough;

each tree engager connecting member having a strut stud and associated finger nut;

the connecting member cross member fixedly coupling the outer ends of the connecting members so as to form the U-shaped configuration;

the upper tree gripper having a generally planar configuration and having an outer edge and an inner edge and two opposing side edges, the inner edge of the upper tree gripper being fixedly attached to the outer edge of the connecting member cross member;

the connecting member cross member having a hook hole therethrough with an associated hook, the hook having a hook end and a threaded end, the connecting member cross member also having an associated tree trunk attachment strap fabricated of a flexible water resistant and tear resistant fabric;

the foot rest also comprising a pair of stop cables having opposing ends and a length therebetween, each of the stop cables being configured to couple a long member end of a vertical support and a free end of a horizontal-support so as to limit the rotation of the horizontal support relative to the vertical support; and a pair of upper portion long struts with each strut having a long member end with a long member coupling hole therethrough for removably coupling each of the upper portion long struts to one of the upper portion long members via a connecting member by using long strut studs and long strut finger nuts, each vertical support end of the long struts having a vertical support end coupling hole therethrough for rotatably coupling each of the long struts to one of the vertical supports.

2. The tree climbing tree stand as described in claim 1, with the stand further comprising:

each base shaft also having an attachment stud and an associated finger nut, with each base shaft finger nut having a plastic head with recesses for easy gripping by a user's fingers;

the lower tree gripper being fabricated of aluminum and having a generally planar configuration;

the outer and middle base shaft cross members having a pair of generally parallel cross member attaching members fixedly coupling the outer base cross member and the middle base cross member;

the swing arm shafts being fabricated of aluminum one inch square hollow tubing, the tubing having an inside surface and an outside surface with a wall thickness therebetween, the swing arm base coupling strips each being fabricated of aluminum;

the swing arm end of each of the swing arm base coupling strips having a rivet hole therethrough with an associated rivet;

the base shaft end of each of the coupling strips having a stud hole therethrough, the coupling strips being located generally between the middle and outer base cross members with the coupling strips each attaching to the swing arm with a rivet in a location between about six inches and eight inches from the outer end of the swing arm;

the first lower flexible tree strap length being about thirty inches;

the long members of the upper portion being fabricated of aluminum one inch square hollow tubing, the long member tubing having an inside surface and an outside surface with a wall thickness therebetween, the wall thickness of the base shafts being between about one-sixteenth and one-half inch in thickness, the inner and outer long member cross pieces all being fabricated of aluminum one inch square hollow tubing, the tubing having an inside surface and an outside surface with a wall thickness therebetween, the wall thickness of the long member cross pieces each being between about one-sixteenth and one-half inch in thickness;

the hammock mounts each having a generally planar configuration having a length of about two inches and a width of about one inch and a thickness of between about three thirty-seconds of an inch and one quarter of an inch, each hammock mount having a long member end with a long member hole and an upper tree engaging end with a tree engager hole;

the tree engager connecting member cross member being located generally perpendicular to both connecting members, the connecting member cross member being made of the same material as the connecting members, the connecting members and cross member being fabricated of aluminum one inch square hollow tubing, the tubing having an inside surface and an outside surface with a wall thickness therebetween, the wall thickness of the connecting members and connecting member cross member being between about one-sixteenth and one-half inch in thickness;

the second upper flexible tree strap length being about thirty inches;

the upper tree gripper having a generally curved plurality of tree gripping teeth with the upper tree gripper having an upper surface and a lower surface with a thickness therebetween;

the connecting member cross member having an outer edge, with the hook threaded end having an associated finger nut, the hook hole being located through the connecting member cross member in a plane being angled to the outer edge of the connecting member cross member;

the vertical support members each having associated bolts, with the bolts rotatably coupling the long member ends of each of the vertical supports to the inner ends of the long members;

a carry harness comprising a pair of first shoulder straps and a second strap and a third strap, the third strap having a pair of ends and an operative length, with each end having a coupling component fastened thereto, each third strap end coupling component allowing for the adjustment of the operative length of the third strap; and the tree trunk attachment strap comprising an inner strap having a cross member attachment loop and an end strap having a looped gripping end.

3. The tree climbing tree stand as described in claim 2, with the stand further comprising:

the foot strap being about two inches in width and between about fifteen inches and thirty inches in length;

the wall thickness of the base shafts each being between about one-sixteenth and one-half inch in thickness;

the inner end of the base shafts having a distance of between about six inches and twelve inches between the base shafts, the outer end of the base shafts having a distance of between about twelve inches and thirty inches between the outer end of the base shafts;

the base cross members being fabricated of a one inch square hollow tubing having an inside surface and an outside surface with a wall thickness therebetween, the wall thickness of the base shafts and base shaft cross members being between about one-sixteenth and one-half inch in thickness, the inner cross member being about ten inches in length, the middle cross member being about twelve inches in length and the outer base cross member being about eighteen inches in length;

the swing arm cross member being fabricated of a one inch square hollow tubing having an inside surface and an outside surface with a wall thickness therebetween, the wall thickness of the swing shafts being between about one-sixteenth and one-half inch in thickness, the swing arm cross member being about twelve inches in length;

the swing arm base coupling strips each being between about eight inches and twelve inches in length, with each strip having a width of about one inch and a thickness of about one-eighth inch;

the first lower flexible tree strap spring steel strip is about thee-quarters of an inch wide, the first lower tree strap spring steel strip has a thickness of between about one-thirty-second of an inch and one eighth of an inch and the flexible material used to cover the first spring steel is urethane, the first lower tree strap having holes with the first lower tree strap holes being about one and one-half inches apart, center to center, with the holes running a length of between about eight inches and eighteen inches from each of the ends of the first lower flexible tree strap;

the connecting members of the upper portion tree engager each having a length of between about twelve and twenty eight inches;

the lower tree gripper being about nine inches in length between the side edges and having a width of about three inches between the inner and outer edges of the lower tree gripper; and the thickness of the lower tree gripper being about one-quarter of an inch.

4. The tree climbing tree stand as described in claim 3, with the stand further comprising:

the inner ends of each of the long members each having a distance of between about fifteen inches and twenty eight inches between the long members, the long members each having a center point defining an equal distance from the center point to the opposing ends of the long members, each long member having a length of between about twenty eight inches and forty inches, the body passageway being an area of between about fifteen inches and twenty eight inches by between about twenty eight inches and thirty eight inches;

the hammock being coupled to the hammock mount by a pair of associated hammock mount bolts;

the netting being a sheet having a length of between about twenty four and forty inches and a width of between about fifteen inches and twenty four inches;

the connecting member cross member of the upper portion tree engager having a length with opposing ends and an inner edge and an outer edge and a top edge and a bottom edge;

each connecting member strut stud and each associated finger nut being located between about six inches and twelve inches from the outer end of the connecting member;

each connecting member strut being fabricated of aluminum and being between about eight inches and twelve inches in length, having a width of about one inch and a thickness of about one-eighth inch;

the upper tree gripper is fabricated of aluminum;

the upper tree gripper being about nine inches in length between the side edges and having a width of about three inches between the inner and outer edges of the upper tree gripper with the upper tree gripper having a thickness being about one-quarter of an inch, the connecting member cross member hook hole being located adjacent the tree gripper and angled away from the tree gripper;

the vertical legs and horizontal legs of the foot rest are each made of a one inch angle aluminum having a length of between about twelve and twenty inches;

the foot rest having a plurality of foot platform supports with the supports each being fabricated of a three-fourths of an inch aluminum square hollow tubing;

each stop cable being similarly configured and having a diameter of between about one sixteenth of an inch and one quarter of an inch, each of the stop cables having a length of between about fifteen inches and twenty five inches;

the long struts of the foot rest being fabricated of three fourths of an inch angle, with each long strut having a length of between about sixteen inches and thirty inches;

the tree trunk attachment strap being about three-fourths of an inch in width and between about one sixteenth of an inch and three sixteenths of an inch in thickness;

the carry harness first shoulder strap having a cross piece end being coupled to the inner long member cross piece of the upper portion, the first shoulder strap also having a free end having a removable fastener attached there to, the second harness strap having two free ends comprising a length of strap having a centrally located third strap attachment area, the free ends of the second strap being removably coupleable to the shoulder strap removable fastener with the free ends of the second strap having an adjustment means to allow the second strap to have an operative length; and the tree trunk attachment strap having a central attachment comprising a pair of strap grips coupled fixedly together, with the inner strap passing through a first strap grip, the tree trunk attachment strap also having an outer strap having a similar configuration as the inner strap, the outer strap passing through a second strap grip which is fixedly coupled to the first strap grip.

5. A tree climbing tree stand comprising, in combination:

a lower foot portion having a first lower flexible tree strap coupled thereto, the lower foot portion having two angled base shafts, the lower foot portion having an inner cross member and a middle cross member and an outer cross member, the middle base cross member having a foot strap fixing location with an associated foot strap, the outer base cross member having a lower tree gripper, the lower foot portion also comprising a swing arm;

the first lower flexible tree strap having two opposing ends and a length therebetween with a plurality of pin holes in both ends of the lower flexible tree strap, the lower flexible tree strap being coupled to the lower foot portion;

the first lower flexible tree strap having an upper surface and a lower surface and two side surfaces, the first lower flexible tree strap having a first end and a second end, the first lower flexible tree strap having a pair of flexible material layers being coupled to a first spring steel strip with the flexible material layers enclosing the first spring steel strip;

an upper portion having a second upper flexible tree strap coupled thereto, the upper portion of the tree climbing tree stand having a second upper flexible tree strap with the second upper flexible tree strap having two opposing ends and a length therebetween, the second upper flexible tree strap having a plurality of pin holes in both ends of the second upper flexible tree strap, the second upper flexible tree strap being coupled to the upper portion, the upper portion forming a body passageway therethrough;

the upper portion also comprising a hammock, the hammock having a pair of generally parallel supports and a hammock cross member, the hammock being rotatably coupled to a hammock mount, the hammock also comprising a length of netting forming a sling with the netting being coupled to the upper portion, the netting being coupled to the hammock thereby forming a sling configuration;

the upper portion also comprising a tree engager;

the upper portion also comprising a foot rest having a pair of vertical legs and a pair of horizontal legs and a plurality of foot platform supports and a pair of stop cables; and the upper portion having a hook hole therethrough with an associated hook, the hook having a hook end and a threaded end, the tree engager further having a connecting member cross member also having an associated tree trunk attachment strap.

* * * * *